United States Patent [19]

Presti, Jr.

[11] Patent Number: 4,551,870

[45] Date of Patent: Nov. 12, 1985

[54] SHOWER STALL THRESHOLD

[76] Inventor: Francis A. Presti, Jr., 1537 E. Frost, Mesa, Ariz. 85203

[21] Appl. No.: 692,511

[22] Filed: Jan. 18, 1985

[51] Int. Cl.[4] ..... A47K 3/22

[52] U.S. Cl. ..... 4/613; 4/612; 52/389; 52/426

[58] Field of Search ..... 4/596, 612, 613, 614, 4/584, 595, 592, 506, 513; 52/98, 425, 426, 389, 342, 384, 390, 673

[56] References Cited

U.S. PATENT DOCUMENTS

| | | | |
|---|---|---|---|
| 1,071,467 | 8/1913 | Savage . | |
| 1,920,503 | 8/1933 | Hadley | 52/390 |
| 2,005,173 | 9/1936 | Deubelbeiss . | |
| 2,484,240 | 10/1949 | Morthland | 4/613 |
| 2,757,385 | 8/1956 | Whittick . | |
| 2,860,505 | 11/1958 | Toulmin, Jr. | 52/425 |
| 4,223,501 | 9/1980 | Delozier | 52/426 |

FOREIGN PATENT DOCUMENTS

| | | | |
|---|---|---|---|
| 1214017 | 4/1960 | France | 52/390 |

*Primary Examiner*—Stephen Marcus

*Assistant Examiner*—Linda J. Sholl

*Attorney, Agent, or Firm*—Cahill, Sutton & Thomas

[57] ABSTRACT

A shower stall threshold structure has two opposed former sections formed of light weight plastic material and adapted to have mortar poured into the space therebetween. The sections are equipped with spacer members and connection bolts to hold the sections in proper spaced relationship until the mortar hardens. Openings through the former sections expose the mortar at the outer faces of the former sections so that tile placed on the sides of the threshold can be adhered to the mortar. One or both former sections may have tile supporting ledges projecting outwardly from their outer faces. A plastic sheet underlying the shower stall may have its edges turned upwardly within the threshold and held in place between the spacer members on the sections. Lines of weakness are provided in the former sections to permit portions of the sections to be broken off to reduce the height of the threshold. Connections at the ends of the former sections permit the sections to be joined with other similar sections to increase the length of the threshold.

12 Claims, 5 Drawing Figures

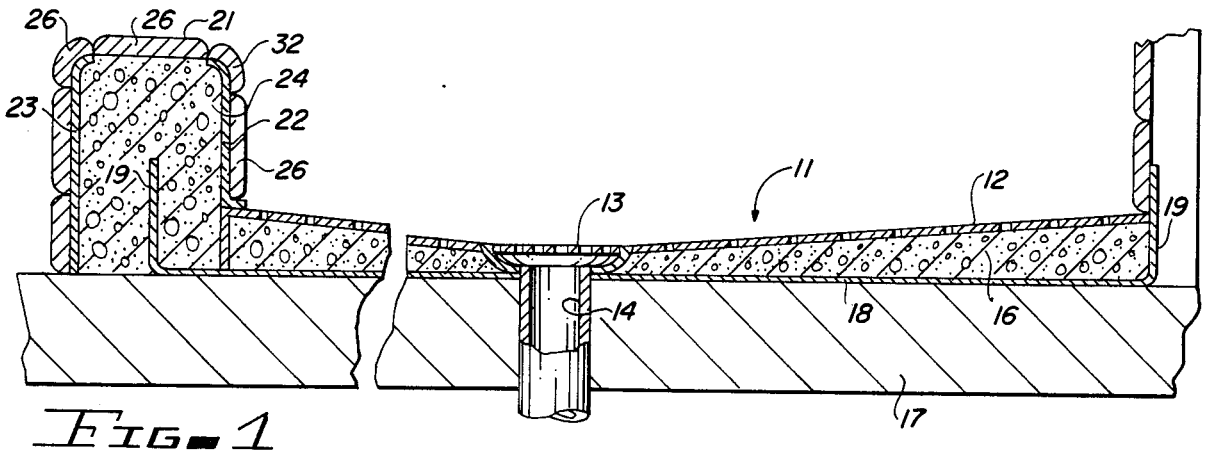
FIG. 1
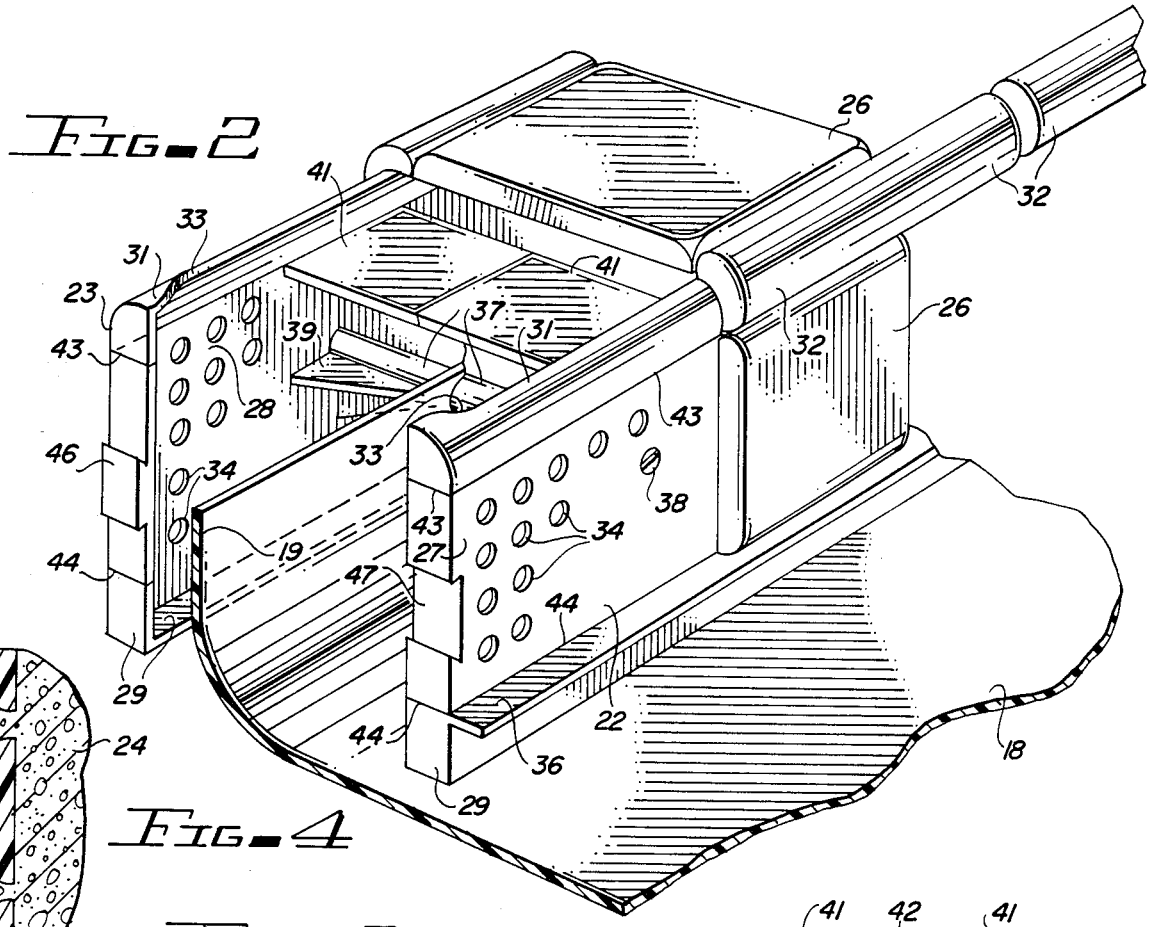
FIG. 2
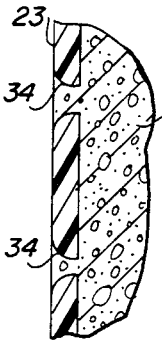
FIG. 4
FIG. 3
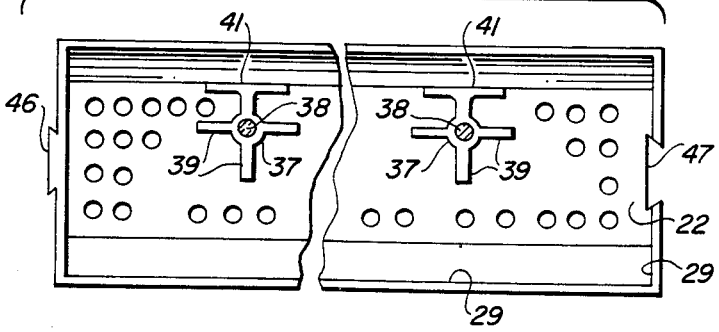
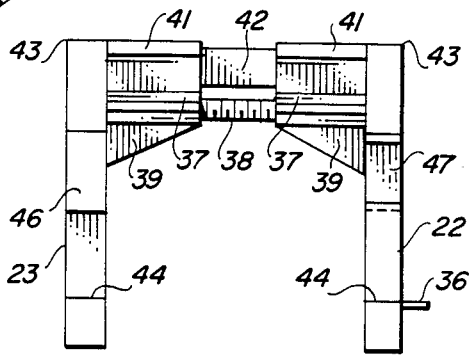
FIG. 5

SHOWER STALL THRESHOLD

TECHNICAL FIELD

This invention relates to the construction of entrance thresholds for tile-lined shower stalls.

BACKGROUND ART

In conventional shower stall construction the entrance threshold is elevated above the floor of the shower to prevent the escape of water. In the construction of custom, tile-lined shower stalls it is the usual practice to set up a form of the general configuration of the threshold and pour mortar into the form to provide a base for the threshold. When the mortar hardens, usually within 24 hours, the form is removed and ceramic tile is adhered to the top and side faces of the formed mortar base. This is a time consuming and expensive procedure because the crew fabricating the stall must make two trips to the construction site, one to build the form and pour the mortar, and another, after the mortar hardens, to remove the form and apply the tile. A threshold formed in this manner is illustrated in U.S. Pat. No. 2,005,173 granted Sept. 22, 1936 to H. S. Deubelbeiss for "Bath Tub".

It has been proposed that the inner portion, or base, of the threshold be formed of precast concrete which can be carried to the construction site. Such items are heavy and unwieldy and particularly difficult to use if the length of the threshold does not match the length of the precast section. Cutting precast concrete requires special tools and is time consuming. It has also been proposed to make precast sections from lighter weight materials, such as foamed plastic, but sections made from these materials are fragile and do not constitute a reliable base for the threshold which often is subjected to the weight of a person entering and leaving the shower stall.

Another approach to shower stall threshold fabrication is suggested by U.S. Pat. No. 2,757,385 granted Aug. 7, 1956 to W. W. Whittick for "Shower Receptor", which discloses a "shower receptor", or floor pan, of fiberglass reinforced plastic material and having a threshold formed integrally therewith. For reasons of economy such structures usually can be made only in a limited range of sizes and shapes so they do not lend themselves to custom installations calling for different sizes and shapes of shower stalls.

Now it has been suggested that building wall structures can be fabricated by pouring concrete bonding material between spaced concrete facing blocks which become locked in place when the bonding material hardens. U.S. Pat. No. 1,071,467 granted Aug. 26, 1913 to R. T. Savage for "Building Construction" discloses such a technique, but contains no suggestion that it might be applicable to shower stall structures.

There remains a need, therefore, for a shower stall threshold structure which can be quickly and inexpensively fabricated and which will possess sufficient strength and integrity to last the life of the building in which it is installed.

DISCLOSURE OF THE INVENTION

This invention contemplates the formation of the base of a shower stall threshold by pouring mortar between a former comprising two spaced former sections which remain in place and become permanent parts of the threshold structure. The former sections are themselves formed by injection molding inexpensive, light weight plastic material and are, therefor, sufficiently inexpensive to be suitable for one time usage.

The former sections are provided with holding means to support the oppositely disposed sections in proper spaced relationship and to hold the sections in that position so as to confine the mortar which is poured therebetween. The holding means preferably includes spacer members intergrally molded to the faces of the holder sections which face each other. The holding means also includes a threaded fastener, such as a bolt, passing through the spacers for holding the sections together. The space between the former sections is, of course, open at the top to receive the mortar and to expose the top surface of the mortar therebetween. The former sections have a plurality of openings throughout the face regions thereof to permit mortar confined between the sections to extend through the sections and be accessible at the outer faces of the sections. Sufficient surface area of the mortar is therefore exposed both at the top of the base of the threshold and at the sidewalls of the threshold to permit tile to be cemented to the mortar in secure fashion.

The holding means for the former sections can also function to position and hold an upturned edge portion of an impervious flexible sheet which underlies floor of the shower stall and serves as a secondary containment vessel for water in the event of failure of the main stall floor.

This invention further facilitates the fabrication of shower thresholds of various sizes and lengths, as is required for custom installations. One such feature of the invention involves the provision of connector means at the ends of the former sections which permit one section to be joined to a like section to increase the length of the base for the threshold. Another feature utilizes lines of weakness provided longitudinally along the former sections in upper and lower regions thereof which permit the top edge portion and the bottom edge portion of a former section to be broken away to reduce the height of the threshold base. And yet a further feature of adjustability of the width of the threshold base is provided by the insertion of additional spacers between the spacer members on the former sections to enlarge the space between opposing sections and, hence, enlarge the width of the threshold base.

Another convenience feature for the former sections constructed in accordance with this invention resides in the provision of ledge-like extensions running longitudinally on the outer faces of the sections to support the lower edge of tiles to be cemented to the threshold base.

BRIEF DESCRIPTION OF THE DRAWINGS

The invention is described in greater detail hereafter by reference to the accompanying drawings, wherein:

FIG. 1 is a vertical sectional view through the lower region of a shower stall having a threshold constructed in accordance with this invention;

FIG. 2 is a fragmentary perspective view of former sections utilized in the frabrication of the threshold;

FIG. 3 is a fragmentary elevational view of the inner face of one of the former sections illustrated in FIG. 2;

FIG. 4 is an enlarged, fragmentary sectional view through a sidewall of one of the former sections; and FIG. 5 is an end view of two former sections which have been modified to form a threshold of a different shape.

BEST MODE FOR CARRYING OUT THE INVENTION

The shower stall embodying this invention and illustrated in FIG. 1 is designated generally by reference numeral 11. Such stalls generally have a tile floor 12 which slopes downwardly to a central drain 13 connected to a drain pipe 14. The tile floor 12 rests atop a poured cement base 16 which rests on the floor structure 17 of the building in which the stall is located. There is usually provided between the cement base 16 and the floor structure 17 an impervious sheet, or film, 18 having upturned peripheral edges 19. Sheet 18 serves as a secondary containment vessel to catch and hold any water which may seep through the tile floor 12 and the cement base 16. Sheet 18 may, for example, be made from flexible vinyl plastic or similar materials.

The stall shower 11 is equipped at its entry way with a raised threshold 21, According to this invention, threshold 21 is formed by a pair of former sections, designated 22 and 23, respectively, having a quantity of mortar, or cement, 24 poured therebetween. Former sections 22 and 23 and the mortar 24 therebetween constitute a base for the threshold 21 which is faced on its top and sides with tiles 26. Most custom shower stalls are lined and the thresholds 26 of such stalls are covered with ceramic tile, although tiles made from other materials, such as plastic, may be used.

Key components of the threshold structure of this invention are the former sections 22 and 23 and these are illustrated in greater detail in FIGS. 2 through 4. The principal function of the former sections 22 and 23 is to receive, shape and hold the mortar 24 which is poured therebetween until such time as the mortar sets and becomes self supporting. Thereafter, although the former sections 22 and 23 remain in place as a portion of the base of the threshold, these former sections are not required to provide any structural strength for the threshold; that function is performed by the hardened mortar 24, the other component of the base. Consistent with this limited function, the former sections 22 and 23 can be manufactured of light weight, inexpensive materials, such as polyetheylene plastic. Such materials can be injection molded in quantity so as to reduce the cost of the former sections 22 and 23 to a level consistent with their one time usage. To keep the thickness of the former section sidewalls, indicated at 27 and 28, respectively, at an absolute minimum (one-sixteenth of an inch or less), the former sections can be stiffened by providing inwardly directed flanges 29 along their upright ends and along their bottom edges. Each section is also preferably provided with an inwardly curved flange 31 along its upper edge. The curvature in the top edge flange 31 is intended to accommodate curved corner tiles 32 which are frequently used in the fabrication of shower thresholds. Portions of curved flanges 31 may be cut away, as indicated at 33, to expose the top face of the mortar to the curved tiles 32 when they are cemented in place on the threshold base. For the same reason the sidewalls 27 and 28 of the former sections 22 and 23, respectively, are provided with a multiplicity of openings 34 which permit the mortar 24 between the former sections 22 and 23 to extend through the openings and be exposed on the outer faces of the sidewalls 27 and 28 to tiles 26 which are cemented to the mortar 24. Of course, because the space between the exposed former sections 22 and 23 is open at the top, the top face of the mortar 24 is directly exposed for cementing contact with the tiles on the top of the threshold 21.

The openings 34 in the sidewalls of the former sections 22 and 23 preferably flair outwardly from the inner to the outer faces of the sidewalls in the manner illustrated in FIG. 4 to expose a substantial surface area of mortar 24 for cementing contact with the tiles 26 and to lock the former sections 22 and 23 firmly to the mortar when it has set.

The openings 34 in the sidewalls of former sections 22 and 23 are preferably quite numerous so as to expose substantial surface areas of mortar 24 to the tiles 26. However, the inner, or smaller, diameter of each opening 34 is preferably of the order of one-quarter inch so that the mortar does not run out of the space between former sections 22 and 23 after it has been poured. This means that once the mortar has been poured the workman fabricating the threshold 21 can immediately begin placing tiles on the faces of the threshold and need not wait until the mortar has set, as was the case with former techniques for forming the threshold. If desired, additional mortar can be trowled into the openings 34 from the outer faces of the formed sections 22 and 23 to insure that the openings are completely filled and that mortar is available for contact with the tiles 26.

As is shown in FIG. 1, the former sections 22 forming the inner face of the threshold base is preferably a fraction of an inch less in height than the section 23 forming the outer face of the threshold face. This insures that the top face of the threshold 21 slopes downwardly toward the interior of the shower stall to cause water accumulating thereon to drain into the stall and to the drain rather than outside the stall. The inner former section 22 is also preferably provided with a longitudinal ledge 36 integrally molded thereon a short distance above the bottom edge of the former section. In a conventionally formed shower stall the periphery of the shower floor is commonly raised a short distance (approximately two inches) above the supporting floor structure. Positioning the ledge 36 at this location above the lower edge of the former section 22 provides a convenient starting place and support for the tiles 26 which are adhered to the inner face of the threshold 21. A similar ledge, not shown, can, if desired, be provided on the outer face of the outer former section 23.

The former sections 22 and 23 must be provided with means for holding these sections in the proper facing and spacing relationship as the mortar is poured therebetween and until such time as the mortar sets and becomes self supporting. This holding means, in accordance with this invention, comprises spacer means in the form of spacer projections 37 integrally molded to the inner faces of sections 22 and 23. Although a single spacer projection 37 could be provided on but one of the former sections 22 and 23 it is preferred that opposing projections 37 be provided, respectively, on the former sections and that each section have two such projections thereon, as shown in FIG. 3. The spacer projections 37 are also adapted to receive the other components of the holding means which takes the form of a threaded fastener, such as a bolt, 38. Bolt 38 passes through a hollow region of a spacer projection 37 on one former section and is threadably received in the opposite spacer projection 37 on the other former section. The spacer projections 37 and sections 22 and 23 may, if desired, be reinforced by means of fillets 39 and T-flanges 41.

The holding means for the former sections 22 and 23, which comprise spacer projections 37 and the threaded fastener 38, also provides a convenient structure for holding upturned edge 19 of secondary containment sheet 18 in an upright position within the threshold 21 as the mortar 24 is poured between the former sections 22 and 23. As shown in FIG. 2, edge 19 of sheet 18 can be simply clamped between spacer projections 37 and held in position by bolts 38 passing through the sheet.

For maximum utility it is desirable that the former sections 22 and 23 possess features which permit the sections to be utilized in the construction of thresholds of different sizes and shapes.

And such features are, indeed, incorporated into the former sections of this invention. If it is desired to construct a wider threshold 21, this is accomplished by the simple expedient of inserting an additional spacer block 42 between the inner ends of the flanges 41 on spacer projections 37, (See FIG. 5). A spacer block 42 of any desired length can be employed to give the desired spacing to the former sections 22 and 23 and, hence, to the base for the threshold which is formed by these former sections.

It is also sometimes desirable to construct a threshold 21 of less height than is provided by the former sections 22 and 23 as they are intially molded. To permit the height of the former sections 22 and 23 to be altered, these members preferable have formed therein during the molding process lines of weakness 43 and 44 which extend longitudinally of the sections in spaced relation, respectively, to upper and lower edges of the former sections. The lines of weakness 43 and 44 extend the full length of the former sections 22 and 23 and extend as well around the flanges 29 at the upright ends of each former section. These lines of weakness 43 and 44 are such that a workman installing a threshold and needing a former section of less height than provided can manually break away either or both the upper edge portion and the lower edge portion of the former sections. FIG. 5 illustrates the use of former sections which have had their upper edge portions broken away at lines of weakness 43 to reduce the height of the former sections 22 and 23. Placement of the lower lines of weakness 44 at or slightly above the longitudinal ledge 36 on a former section permits the lower edge portion as well as the ledge 36 to be broken away from the remainder of the former section if those portions are not required in the construction of the threshold One final feature of versatility of the former sections 22 and 23 in the fabrication of thresholds 21 of different sizes is provided by means at the ends of former sections 22 and 23 for locking these sections to the ends of similar sections for the purpose of increasing the length of the threshold. As best shown in FIGS. 3 and 4, this locking means may take the form of male dovetail members 46 and female dovetail members 47 formed at the respective ends of the former sections. It is contemplated that former sections 22 and 23 will be molded in fairly short lengths, of the order of two feet. As many of these sections as are needed can be readily connected end to end to form the correct length threshold.

From the foregoing it should be apparent that this invention provides a highly versatile shower stall threshold structure which can be adapted to a variety of custom installations The construction is such as to significantly reduce the quantity of manual labor which must be employed in the construction of a threshold, but which, at the same time, assures presision and reliablity of the finished threshold.

What is claimed is:

1. A shower stall threshold structure comprising oppositely-disposed upright former sections extending longitudinally of the threshold, means for holding the sections in fixed spatial relationship, a quantity of mortar substantially filling the space between said former sections and tiles covering the top and side face of the threshold, said former sections having openings therein permitting said mortar to extend therethrough for contact with said tiles.

2. The threshold structure of claim 1 wherein said holding means comprises a spacer member secured to the inner face of at least one of said former sections.

3. The threshold structure of claim 2 wherein said holding means further comprises a threaded fastener extending between said former sections.

4. The threshold structure of claims 1, 2 or 3 including a liquid impervious flexible sheet underlying the stall and having an upturned edge grasped by said holding means.

5. The threshold structure of claim 1 wherein at least one of said sections has a tile supporting ledge formed on the outer face thereof.

6. A shower stall threshold former comprising oppositely-disposed former sections having inner and outer faces, respectively, the inner faces of said sections being in facing relationship, spacing means provided on the inner face of at least one of the sections for determining the spacing between said sections, and means for connecting said sections and for holding the sections in fixed spatial relationship when the space therebetween is filled with mortar, said sections each having a plurality of openings therethrough to permit mortar to extend therethrough and be accessible at the outer face of each section.

7. The former of claim 6 wherein at least one of said sections has a longitudinal ledge projecting from the outer face thereof adapted to support tiles against said face.

8. The former of claim 6 wherein each of said sections has upright ends and a lower edge and stiffening flanges projecting inwardly from said ends and said lower edges.

9. The former of claim 6 wherein said spacing means has its uppermost region spaced beneath the upper edge of said section and the sections are provided with longitudinal lines of weakness above said spacing means which permit portions of said sections above the lines of weakness to be broken away to reduce the height of said sections.

10. The former of claim 7 wherein the section having the longitudinal ledge has a longitudinal line of weakness in the vicinity of said ledge to permit a lower portion of the section to be broken away from the rest of the section.

11. The former of claim 6 wherein said sections have upright ends and means at said ends to permit the ends of the sections to be connected to ends of other sections.

12. The former of claims 6 or 8 wherein said sections have upper edges and inwardly curved regions adjacent said upper edges.

* * * * *